US005903099A

United States Patent [19]

Johnson et al.

[11] Patent Number: 5,903,099

[45] Date of Patent: May 11, 1999

[54] FABRICATION SYSTEM, METHOD AND APPARATUS FOR MICROELECTROMECHANICAL DEVICES

[75] Inventors: A. David Johnson, San Leandro, Calif.; Heinz H. Busta, Plainsboro, N.J.; Ronald S. Nowicki, Sunnyvale, Calif.

[73] Assignee: TiNi Alloy Company, San Leandro, Calif.

[21] Appl. No.: 08/862,649

[22] Filed: May 23, 1997

[51] Int. Cl.[6] ..... H01J 9/24

[52] U.S. Cl. ..... 313/495; 216/2; 445/24

[58] Field of Search ..... 445/24; 216/2; 313/495; 337/140

[56] References Cited

U.S. PATENT DOCUMENTS 5,061,914 10/1991 Busch et al. ..... 337/140
5,734,224 3/1998 Tagawa et al. ..... 313/493
5,795,206 8/1998 Cathey et al. ..... 445/24

*Primary Examiner*—Kenneth J. Ramsey
*Attorney, Agent, or Firm*—Flehr Hohbach Test Albritton & Herbert LLP

[57] ABSTRACT

A fabrication system and method of fabrication for producing microelectromechanical devices such as field-effect displays using thin-film technology. A spacer is carried at its proximal end on the surface of a substrate having field-effect emitters with the spacer being enabled for tilting movement from a nested position to a deployed position which is orthogonal to the plane of the substrate. An actuator is formed with one end connected with the substrate and another end connected with spacer. The actuator is made of a shape memory alloy material which contracts when heated through the material's phase-change transition temperature. Contraction of the actuator exerts a pulling force on the spacer which is tilted to the deployed position. A plurality of the spacers are distributed over the area of the display. A glass plate having a phosphor-coated surface is fitted over the distal ends of the deployed spacer.

20 Claims, 4 Drawing Sheets

FABRICATION SYSTEM, METHOD AND APPARATUS FOR MICROELECTROMECHANICAL DEVICES

GOVERNMENTAL AGENCY RIGHTS

The following governmental agencies have certain rights in the invention: NASA contract NAS10-12263; Ballistic Missile Defense Organization contract N00167-96-C-4037; U.S. Navy contract N00024-95-C-4126; and National Science Foundation grant no. DMI9561491.

BACKGROUND OF THE INVENTION

1. Field of the Invention

This invention relates in general to microelectromechanical systems, also known as MEMS, in which mechanical micro-components are fabricated for use in electronics, for example in flat panel displays employing field-effect display (FED) technology.

2. Description of the Related Art

Electronic displays are rapidly becoming one of the major components in the emerging information highway system. Among the well-known displays are cathode ray tubes, plasma displays, electroluminescent panels and active matrix liquid crystal displays. Flat panel displays have been emerging as replacements for cathode ray tubes in television, computer monitors and other electronic visual displays. Field-effect flat panel displays have been developed which provide large two-dimensional screens with less weight and reduced costs as compared to the large envelopes required for displays such as cathode ray tubes. FEDs also have certain advantages over liquid crystal displays, electroluminescent and plasma displays because the FEDs have greater luminosity, lower power requirements, and are not limited in viewing angle or speed of operation.

The FED technology has advanced to the point of using cold field emission with microfabrication techniques to produce dense arrays of micron-sized cones in silicon dioxide. Microfabrication of sharp points on the cones leads to high fields and short flight distances, resulting in adequate focusing. The use of microfabrication techniques makes it possible to manufacture thousands of the devices simultaneously so that the cost of manufacture is low.

Flat panel displays are placed in large flat vacuum envelopes of which one panel is of a suitable transparent or translucent material such as glass. One surface of the glass panel is coated with a pattern of highly efficient phosphors. Atmospheric pressure will distort or collapse the glass panel unless it is made of thick glass or adequately supported over its surface. For making envelopes sufficiently light in weight, the preferred solution is to place spacers at frequent intervals within the vacuum space to maintain the distance between the front and back surfaces. While certain university research projects have provided experimental displays in which micron-scaled components have been manipulated into position on a substrate surface to support an overlying glass plate, such an arrangement is impractical for large scale, low cost commercial manufacture of FEDs. This is because the size of practical FEDs requires many thousands of the supporting elements distributed over a substrate surface such that it would be impractical to individually manipulate the components into position.

It is also advantageous if the supporting spacer is fabricated as a part of the FED device, a feature which has not been achieved in the prior art. It is required that hundreds or even thousands of the small spacers be accurately machined and strategically placed among the emitters. The spacers must also not interfere with electrical functioning nor impede the evacuation of air. Microfabrication of the spacers must be compatible with other manufacturing operations utilized in fabricating the emitters. In an FED there are narrow spaces or "streets" between emitter pixels so that the spacers, and actuators for the spacers, must be thin and long to fit within those narrow streets.

The need has therefore been recognized for a microelectromechanical fabrication system, method and apparatus which obviates the foregoing and other limitations and disadvantages of the prior art. Despite the various microelectromechanical systems and devices in the prior art, there has heretofore not been provided a suitable and attractive solution to these problems.

OBJECTS AND SUMMARY OF THE INVENTION

It is a general object of the present invention to provide a new and improved fabrication system and method for producing a microelectromechanical device in which planar structures are supported in parallel, spaced-apart relationship.

Another object is to provide a fabrication system and method of the type described in which submillimeter-sized spacers coupled with individual actuators of shape memory alloy material, are formed by micromachining techniques on a substrate. The actuators, upon application of heat, move the spacers to upright positions at which they support a planar structure at a distance above the substrate.

Another object is to provide apparatus comprising a microelectromechanical device in which planar structures are supported in parallel, spaced-apart relationship by submillimeter-sized spacers which are formed by micromachining techniques from one of the structures.

The invention in summary provides a fabrication system, method and apparatus in which planar structures are supported in spaced-apart relationship by a plurality of spacer elements. Each spacer element is mounted for tilting movement at its proximal ends to one structure, with the spacer being parallel with that structure in a nested position. For each spacer, an actuator is carried on the first structure. Each actuator is formed of a metal alloy material which is characterized in undergoing deformation when heated through a phase-change transition temperature. When the actuator is heated through the transition temperature, it deforms and applies a force on the spacer which tilts the spacer upright to a deployed position where the distal end of the spacer is in supporting relationship with the other planar structure.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
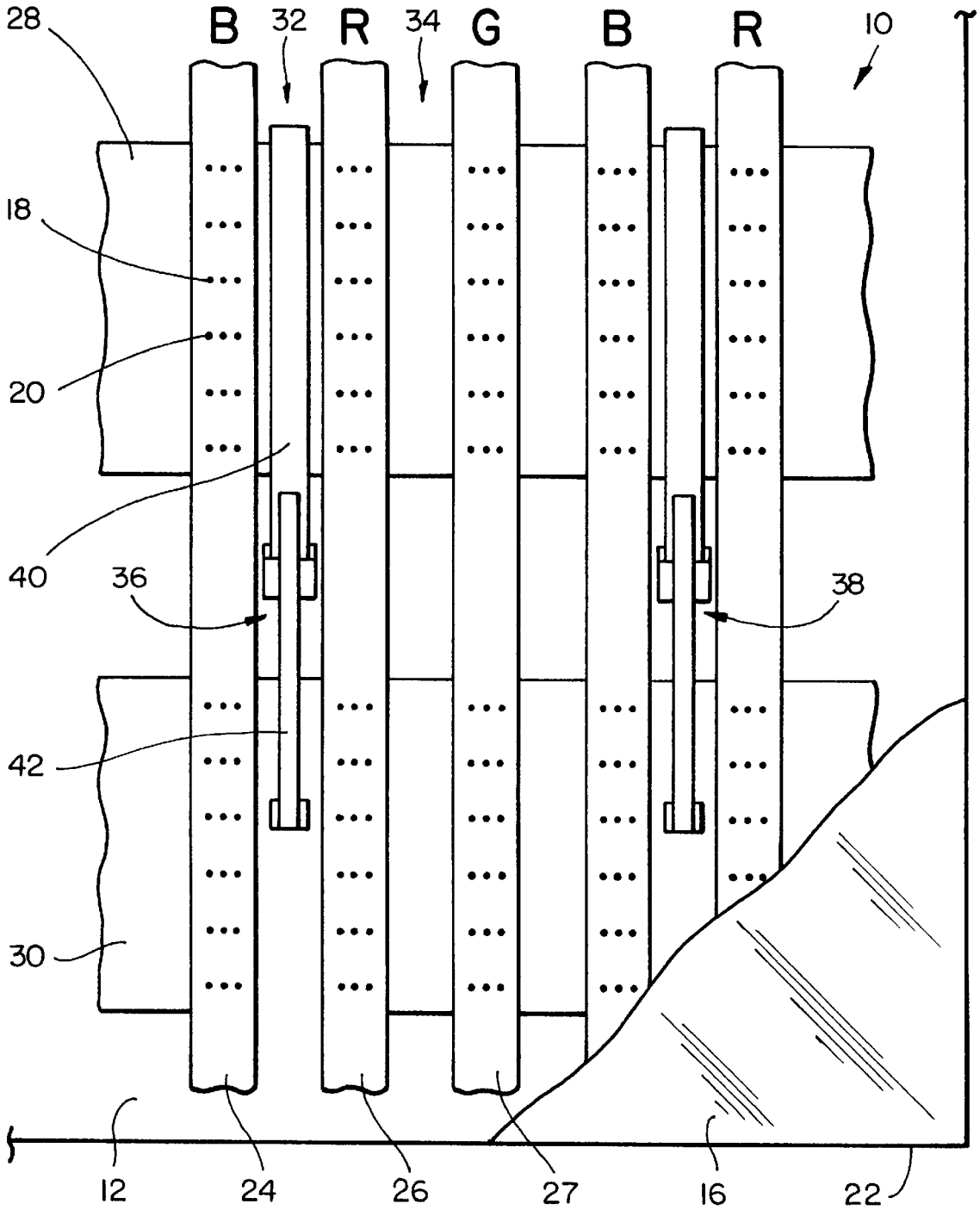
FIG. 1 is a top plan view, partially broken away, showing a portion of a field-effect flat panel display incorporating the invention.

In the drawings FIG. 1 illustrates generally at 10 a field-effect display incorporating one embodiment of the invention. Display 10 is of the type which provides a low temperature field emission of fast electrons which are emitted from a first structure or substrate 12 and travel across a vacuum. The electrons strike a phosphor coated inner surface 14 of a second planar structure 16 which is formed of a suitable transparent or translucent material such as glass. The coating of phosphors is arranged in the desired display pattern, and they can be selected to provide the desired color patterns, such as the primary colors red, blue and green. Substrate 12 is formed with a dense array of micrometer-sized cones 18, 20. When voltage is applied from a suitable source, not shown, electrons are emitted out from the cones. An hermetical seal is formed by suitable means between the peripheral edges 22 of the glass plate 16 and the substrate. The gap between the inner surfaces of the substrate and glass plate can be on the order of 200 microns.

A typical array of the electron emitters is shown in FIG. 1. A plurality of gate lines 24, 26, and 27 run in parallel spaced-apart relationship orthogonal to the direction of a plurality of emitter lines 28, 30. Each gate line is formed with a series of groups of the closely spaced gated field emitter cones 18, 20. Electrons emitted from the cones in each gate line strike areas of phosphors of a particular color on the glass plate. For example, electrons emitted from gate line 24 would strike blue phosphors, electrons from gate line 26 would strike red phosphors and electrons from gate line 27 would strike green phosphors. Running between adjacent gate lines are relatively thin and long spaces or "streets" 32, 34. Each such street has a width of about forty microns.

Figure 3:
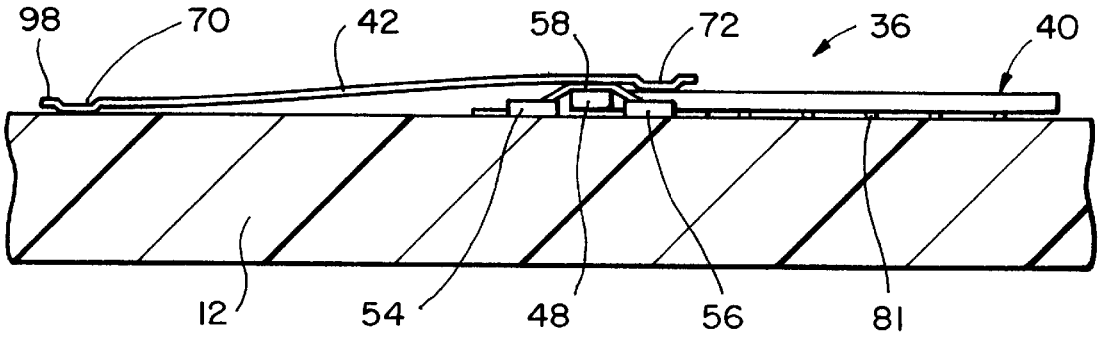
FIG. 3 is a cross sectional view taken along the line 3—3 of FIG. 2.

A large plurality of spacer-actuator units 36–38 are positioned within the streets between the gate lines. Each such unit is comprised of a spacer 40 and actuator 42. The spacer can be forty microns wide and two hundred microns long or longer, or shorter depending on the particular application. The actuator can be about two hundred fifty microns long, twenty microns wide and two microns thick. When actuated the spacers extend orthogonal with the plane of the substrate in the manner explained below. The spacers serve as strong columns for supporting the glass panel and to resist the force of atmospheric pressure to prevent collapse of the panel into the vacuum of the gap. Using the micromachining techniques explained below, the actuators and spacers are fabricated with each spacer in a nested position parallel with the surface of the substrate, as illustrated in FIG. 3. Just prior to closing the volume by placing the glass plate in place, the actuators are energized to erect the spacers by tilting them through a 90° angle to the position shown in FIG. 4. Next, the glass plate is lowered into contact with the distal ends of the spacers and then sealed about its outer periphery. The volume in the gap between the substrate and plate is then evacuated to a pressure on the order of $10^{-7}$ torr.

In the preferred embodiment with the substrate and glass plate in parallel, spaced-apart relationship, all of the spaces would be of equal lengths. The invention also contemplates an arrangement in which the glass plate inclines at an angle relative to the substrate, and the length of the spacers would then be varied as required to provide the support.

Figure 2:
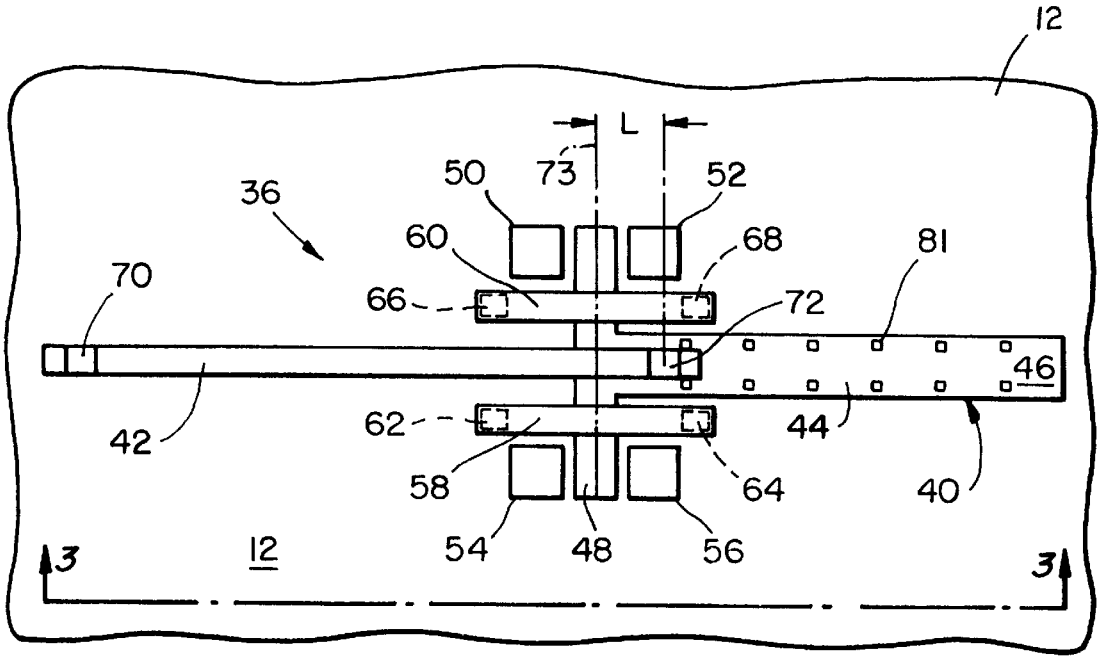
FIG. 2 is a top plan view, to an enlarged scale, showing component elements of the flat panel display of FIG. 1.
Figure 4:
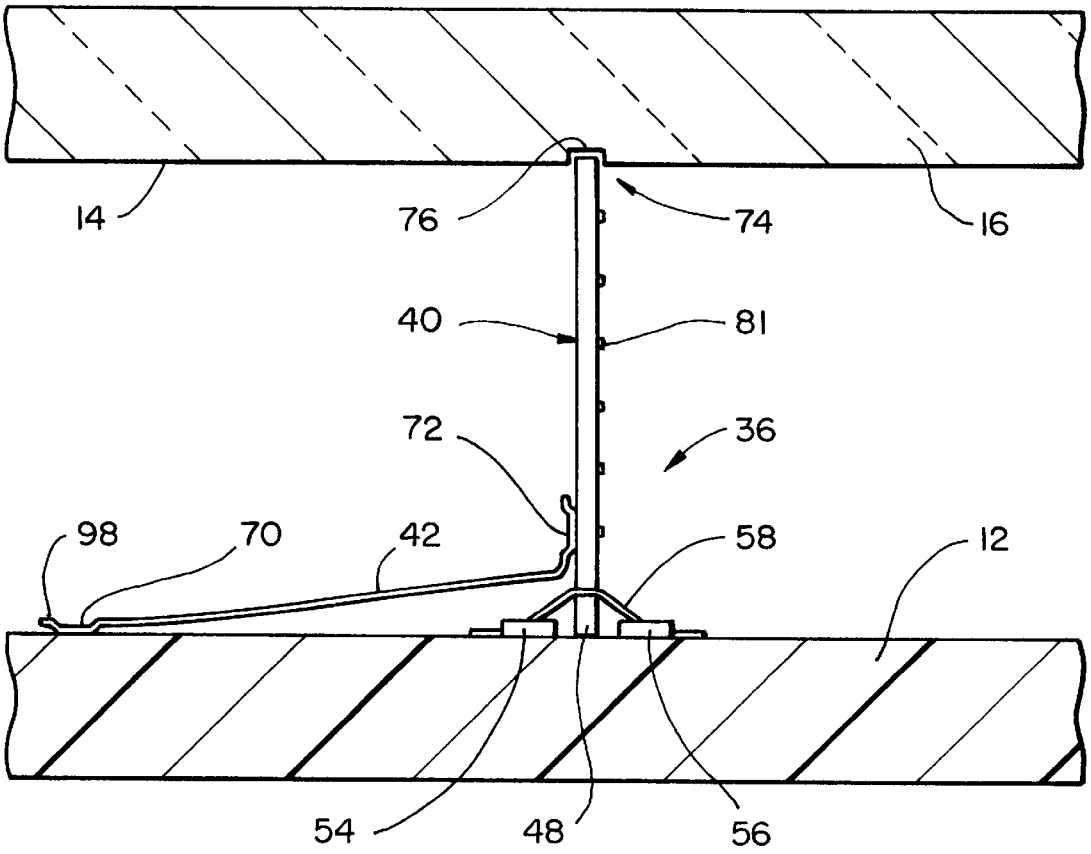
FIG. 4 is a cross sectional view similar to FIG. 3 showing moved positions of the spacer and actuator components.
Figure 5:
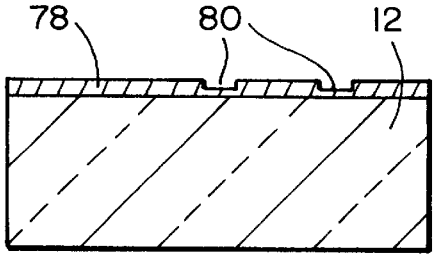
FIG. 5 is a schematic fragmentary section view showing the substrate in FIG. 4 illustrating one step in the fabrication thereof.
Figure 6:
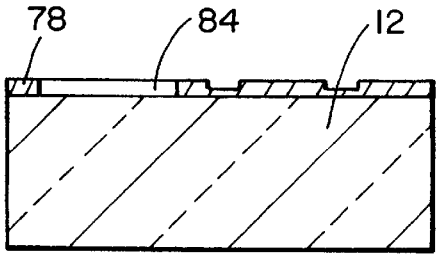
FIG. 6 is a view similar to FIG. 5 illustrating a further step in the method of fabrication.

FIGS. 2–4 illustrate details of the typical spacer-actuator unit 36 employed in the display of FIG. 1. Unit 36 is comprised of the T-shaped spacer 40 in combination with the elongate actuator 42. Spacer 40 is formed with an elongate shank 44 having a distal end 46 and a transversely extending head 48 at its proximal end. The head is captured between, and is also free to tilt about its long axis between pairs of spaced-apart support blocks 50, 52, and 54, 56 which extend upwardly from substrate 12. The spacer head is captured between the support blocks by a pair of holding straps 58, 60. The holding straps are preferably formed of a nickel-titanium metal alloy material, and each strap is connected at its opposite ends to pairs of anchor pads 62, 64 and 66, 68 that are formed on the substrate.

Actuator 42 of each unit is formed at its opposite ends with downwardly U-shaped anchor feet 70 and 72. Anchor foot 70 connects with the substrate while anchor foot 72 connects with the proximal end of the spacer at a location which defines a moment arm length L from the axis 73 of head 48 about which the spacer rotates or tilts.

Actuator 42 is formed of a metal alloy material which is characterized in undergoing a phase change from martensite to austenite when heated through a phase-change transition temperature. Such materials are commonly known as shape memory alloys ("SMA"). A preferred SMA material is TiNi (Nitinol), an alloy of nearly equal atomic amounts of nickel and titanium. Other suitable SMA materials that could be employed include CuAlNi and TiNiPd alloys. These SMA materials are characterized in being easily deformed when cold (i.e. at a temperature below the transition temperature) and which produce large stresses, with shape recovery of several percent, when heated through the austenitic phase change range (i.e. through the transition temperature). The transition temperature is predetermined in accordance with the particular composition of the alloy which is employed.

In order to use the shape memory phenomenon, typical SMA devices require that a biasing force be used to pre-stretch the SMA material, and it is this pre-bias which is recovered during the "memory" recovery during a phase change from martensite to austenite. The present invention does not provide for a mechanical pre-strain action. Instead, the invention utilizes the volume change of the SMA material which takes place during the phase change to provide the pre-bias.

In the invention the SMA material, such as TiNi, is sputter-deposited in an amorphous state as a thin film over a substrate. The SMA film is then heat treated to create the crystalline structure which leads to the martensite transformation. The process for forming such a thin film of SMA material is disclosed in the Busch et al. U.S. Pat. No. 5,061,914, the disclosure of which is incorporated herein.

The heat treatment comprises an annealing step in which the film of amorphous SMA is heated to a temperature where it is crystallized into the austenite phase. For example, TiNi is annealed by heating to about 500° C. The SMA is then cooled to its phase transformation temperature, which would be below 100° C. for TiNi. During cool-down from the crystallization temperature to the phase transformation temperature, differential thermal expansion between the SMA and the substrate creates stress at their interface. This stress arises because, first, the SMA film is bonded to, and cannot move relative to, the underlying substrate, and second, the SMA material has a greater coefficient of thermal expansion ($\alpha$) than the $\alpha$ of the substrate material. Upon further cooling to room temperature, this stress is relieved during the phase change to martensite. The SMA is then released from the substrate by photolithography, remaining attached only at one end to the substrate and at its other end to the spacer. Upon subsequent heating through the phase change, the SMA contracts in the range of between about 0.5% and 1% of its length due to the shape-memory effect. The degree of stress that is created at the interface between the SMA and substrate is a function of a ratio $\alpha_1/\alpha_2$ where $\alpha_1$ is the coefficient of thermal expansion for the particular type of SMA employed and $\alpha_2$ is the corresponding coefficient for the particular substrate. In the preferred embodiment, the SMA is TiNi and the substrate is glass. If the substrate material employed has a lower $\alpha$ than Si, then the actuator would produce a larger contraction.

Contraction of the actuator exerts a strong pulling force at the area 72 of attachment to the spacer shape. This pulling force acts through the moment arm length L, creating a force couple on the spacer which is thereby tilted from the nested position shown in FIG. 3 through 90° to the deployed position shown in FIG. 4. The ratio of the length of the moment arm length L to the length of the actuator is made equal to percent length contraction of the actuator during its phase change so that the spacer tilts through the desired 90° angle. For example, where the actuator contracts 1% during phase change it would be made with a length 100 times moment arm length L. The contraction is reversible so that, to prevent the spacer from moving from its deployed position, a latch 74 is provided. The latch is shown in FIG. 4 and comprises a recess or pit 76 formed on the inner surface of the glass plate in register with the spacer's distal end. During final assembly when the glass is moved to the position shown in the figure, the spacer's distal end engages the recess.

Figure 7:
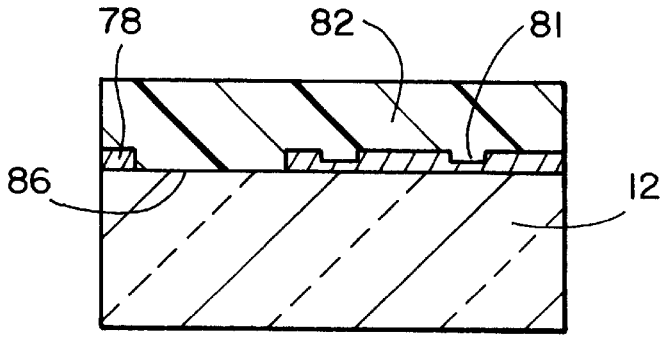
FIG. 7 is a view similar to FIG. 6 showing a further step in the method of fabrication in which polysilicon is deposited on the substrate.
Figure 8:
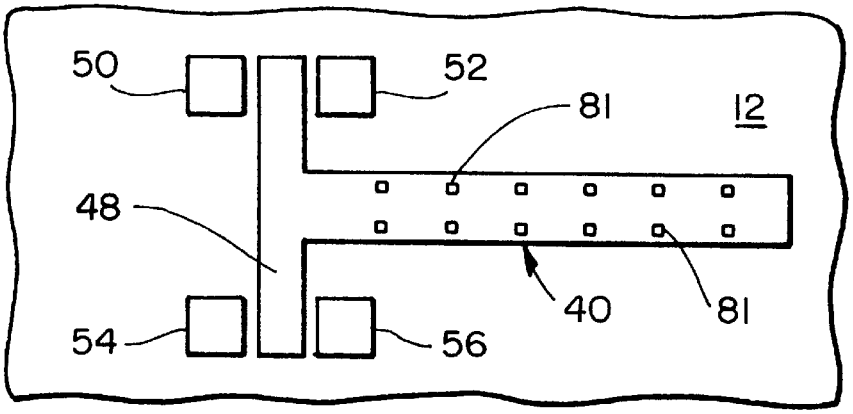
FIG. 8 is a fragmentary top plan view of the shaped elements of polysilicon deposited on the substrate shown in FIG. 7 and illustrating a further step in the method of fabrication.

FIGS. 5–9 illustrate the method of fabricating a plurality of the spacer-actuator units 36–38 in the field-effect display of FIG. 1. The initial step begins with a glass substrate 12, shown in FIG. 5, on which the pattern of micron-sized emitter cones have been fabricated. A layer 78 of Al, which is a sacrificial layer with a thickness on the order of 1–2 microns, is deposited on the upper surface of the substrate. A pattern of small depressions 80 is photoshaped on the Al surface, and these depressions will be transferred to create small "dimples" 81 on the next layer 82 of polysilicon, which is deposited as explained in connection with FIG. 7. In the next step of FIG. 6, the Al layer is masked and then etched through openings 84 to create spots which will be transferred to become the "bosses" 86 on the polysilicon layer which is applied in the step of FIG. 7. These bosses combine to form the support blocks 50–54 in FIG. 8. In FIG. 7 the polysilicon layer 82 with a thickness on the order of 1–5 microns is deposited. In the next step of FIG. 8 the outer surface of the polysilicon is photoshaped and etched to form the T-shaped spacer 40 and the four support blocks 50–56. The spacer is formed entirely of polysilicon, and the plurality of small dimples 81 on its lower surface prevent the spacer from adhering to the glass surface after the sacrificial layer of Al has been etched. A plurality of holes, not shown, are formed through the spacer so that the subsequent step of etching the sacrificial Al layer will be accomplished rapidly with the holes permitting the etchant to access the Al.

Figure 9:
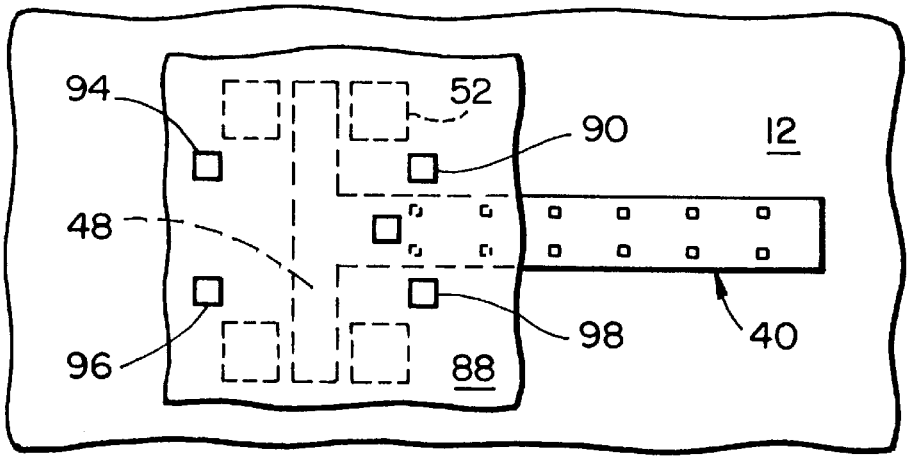
FIG. 9 is a view similar to FIG. 8 showing a further step in the method of fabrication.

In the step of FIG. 9 a second sacrificial Al layer 88, having a thickness on the order of 1–2 microns, is deposited over the polysilicon and over the first sacrificial layer. Four holes 90–96 are etched through the two Al layers, and these holes when filled with SMA material from the next step become the anchors 62–68 for the SMA straps 58, 60. These straps extend across and constrain the head of the actuator as the actuator tilts. In addition a pair of holes, not shown, are formed through the Al layers over opposite ends of the area which defines the actuator. These holes when filled with SMA material from the next step form the anchor feet 70 and 72 of the actuator. In the next step the SMA material, preferably TiNi, is sputter-deposited, heat treated and photoshaped to create the actuator as well as the anchor straps. As shown in FIGS. 3 and 4, each actuator 42 is attached at one end 98 to the substrate glass and at its other end to the spacer at area 72. The remainder of the actuator, when in its undeformed shape, lies on the surface of the Al layer. The sacrificial layers of Al are then etched away to release the actuators and the spacers from the substrate.

In the next fabrication step the SMA material is heated through its transition temperature. Preferably all of the actuators in the FED are heated simultaneously, and this can be advantageously accomplished by placing the substrate against a heat source, such as a hot plate. Where the SMA material is TiNi the substrate and actuators would be heated to a temperature on the order of 100° C. to effect the martensite crystalline phase change. The material undergoes deformation by a change in volume which contracts the actuators to tilt all of the spacers upright at the same time. The ends of the actuators connected with the spacers are sufficiently flexible to bend as the shank of the spacer is raised.

In the next step glass plate 16 is moved into position in spaced-apart relationship above substrate 12 with recesses 76 brought into engagement with the distal ends 46 of the spacers in the manner shown in FIG. 4. The peripheral edges 22 of the enclosure for the FED are then sealed and the volume between the glass plate and substrate evacuated to create the desired level of vacuum. The sealing could also be performed in a vacuum chamber by joining the two plates and then heating a glass frit gasket, not shown, with a laser beam. The combined column strength of the spacers is sufficient to prevent distortion or collapse of the glass plate under the forces of atmospheric pressure.

From the foregoing it is evident that applicants have provided herein a new and improved fabrication system, method and apparatus for producing microelectromechanical devices. In the illustrated FED application, thin-film SMA microactuators are made in a wafer by micromachining techniques. The microactuators produce large displacements in a small space with significant force which is effective to tilt the spacers upright. After the components have been fabricated in the surface of the wafer, the substrate can be heated to produce simultaneous actuation of the spacers, or else the substrate can be partially heated and then laser-pulsed to bring the SMA actuators to the transition temperature. With the high vacuum created in an FED application, the large number of micro columns formed by the spacers reinforce the glass panel against collapse or distortion from atmospheric pressure.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A flat panel display apparatus comprising a substrate having a surface formed with a plurality of light emitters, a plurality of spacers positioned in an array over the substrate surface, each spacer having a distal end together with a proximal end which is mounted on the substrate surface for tilting movement from a nested position to a deployed position, an actuator carried on the substrate surface, the actuator being formed of a metal alloy material which is characterized in undergoing deformation when heated through a phase-change transition temperature, the actuator contracting responsive to said change in volume, the actuator being connected with the spacer to move the spacer toward the deployed position responsive to said contraction of the actuator, and a translucent panel having a surface which is mounted on the distal ends of the spacers in their deployed positions with the spacers supporting the substrate and panel in spaced-apart relationship.

2. A flat panel display apparatus as in claim 1 in which the panel comprises a latch which engages the distal end of the spacer for holding the spacer against movement from its deployed position.

3. A fabrication system for use in producing a microelectromechanical device in which first and second planar structures are supported in spaced-apart relationship with a gap separating the structures, the fabrication system comprising the combination of a spacer having a proximal end and a distal end, the spacer being carried at its proximal end on the first structure for movement from a nested position to a deployed position, an actuator carried on the first structure, the actuator being formed of a metal alloy material which is characterized in undergoing deformation from a first shape to a second shape when heated through a phase-change transition temperature, and the actuator having one end connected with the first structure and another end connected with the spacer at a location which defines a moment arm length from said distal end which enables the actuator to apply a force which acts through the moment arm length and move the spacer toward the deployed position responsive to the actuator deforming to the second shape, the spacer in the deployed position being in a supporting relationship with the second structure for resisting collapse of the first and second structures into the gap.

4. A fabrication system as in claim 3 in which the proximal end of the spacer is supported by the distal end on the first structure for enabling the spacer to tilt from the nested position to the deployed position.

5. A fabrication system as in claim 3 in which the spacer in its nested position is substantially coplanar with the first structure.

6. A fabrication system as in claim 3 in which the actuator is elongate, and said actuator deforms by contraction from the first shape to the second shape.

7. A fabrication system as in claim 3 in which said microelectromechanical device comprises a flat panel display, and the first structure comprises a field effect emitter.

8. A fabrication system as in claim 7 in which the field effect emitter comprises a wafer having a plurality of polysilicon layers.

9. A fabrication system as in claim 8 in which the spacer is comprised of polysilicon.

10. A fabrication system as in claim 8 in which the spacer is comprised of a base together with a shank extending from the base, the base being positioned on one layer of said polysilicon layers.

11. A fabrication system as in claim 10 in which the shank extends substantially orthogonal with said one layer when the spacer is in the deployed position.

12. A fabrication system as in claim 10 in which the spacer is free to tilt about the base relative to said one layer responsive to said application of the force, and the shank has a distal end which is in supporting relationship with the second planar structure when the spacer is in the deployed position.

13. A fabrication system as in claim 3 which comprises a plurality of said spacers, the spacers being arrayed in positions which are spaced-apart and with the distal ends of the spacers being in said supporting relationship at positions which are spaced apart along the second structure.

14. A fabrication system as in claim 3 and further comprising a latch which engages the spacer in said deployed position for holding the spacer against displacement with respect to the second structure.

15. A fabrication system as in claim 14 in which the latch is comprised of a recess formed in the second structure at a position which registers with the distal end of the spacer for enabling engagement of the distal end with the recess responsive to movement of the spacer to its deployed position.

16. A method of fabricating a microelectromechanical device in which first and second planar structures are supported in spaced-apart relationship with a gap separating the structures, the method comprising the steps of positioning a spacer on one surface of the first structure while holding the spacer in a nested position along a side of the first structure, providing an actuator on said one surface of the first structure with the actuator having a first shape, the actuator being formed of a metal alloy material which is characterized in undergoing deformation from a first shape into a second shape when heated through a phase-change transition temperature, heating the material through the phase-change transition temperature and deforming the actuator to the second shape, applying a force couple on the spacer responsive to said deformation of the actuator to the second shape, moving the spacer responsive to the force couple from the nested position to a deployed position in which a distal end of the spacer extends outwardly from the first structure, and supporting the second structure on the distal end of the spacer in said substantially parallel, spaced-apart relationship with said gap being established between the structures and with the spacer resisting collapse of the first and second structures into the gap.

17. A method as in claim 16 which includes the step of securing the distal end of the spacer to the second structure to prevent the spacer from moving toward the nested position.

18. A method as in claim 16 in which the step of deforming the actuator to the second shape is carried out by contracting the actuator.

19. A method as in claim 18 which includes the steps of supporting a proximal end of the spacer for pivotal movement on said one surface of the first structure, and the step of applying the force couple is carried out by causing the actuator during said contraction to apply a pulling force on the spacer at a distance from the proximal end of the spacer.

20. A method as in claim 16 in which the spacer is elongate along an axis which, when the spacer is in its nested position, extends substantially parallel with the first planar structure, and the step of moving the spacer to the deployed position is carried out by tilting the spacer through an angle sufficient to cause the deployed position to be substantially orthogonal with said first planar structure.

* * * * *

UNITED STATES PATENT AND TRADEMARK OFFICE

CERTIFICATE OF CORRECTION

PATENT NO. : 5,903,099 
DATED : May 11, 1999
INVENTOR(S) : A. David Johnson, Heinz H. Busta and Ronald S. Nowicki It is certified that error appears in the above-identified patent and that said Letters Patent is hereby corrected as shown below:

Column 7,
Line 5, correct claim 1 to read:

1. A flat panel display apparatus comprising a substrate having a surface formed with a plurality of light emitters, a plurality of spaces positioned in an array over the substrate surface, each spacer having a distal end together with a proximal end which is mounted on the substrate surface for tilting movement from a nested position to deployed position, an actuator carried on the substrate surface, the actuator being formed of a metal alloy material which is characterized in undergoing deformation when heated through a phase-change transtition tempature, the acutator contracting responsive to said deformation, the actuator being connected with the spacer to move the spacer toward the deployed position responsive to said contraction of the actuator, and a translucent panel having a surface which is mounted on the distal ends of the spacers in their deployed positions with the spacers supporting the substrate and panel in spaced-apart relationship.

Signed and Sealed this

Sixteenth Day of July, 2002

*Attest:*

*Attesting Officer*

JAMES E. ROGAN
*Director of the United States Patent and Trademark Office*